US006065697A

United States Patent [19]

Engel et al.

[11] Patent Number: 6,065,697

[45] Date of Patent: May 23, 2000

[54] APPARATUS FOR TREATING COMPOSITE ELEMENTS

[76] Inventors: Rudolf Engel, Weinbergstrasse 25a, CH-8353, Elgg; Christoph Muther, Sonnhaldenstrasse 44, CH-6030 Ebikon, both of Switzerland

[21] Appl. No.: 09/117,023

[22] PCT Filed: Dec. 28, 1996

[86] PCT No.: PCT/EP96/05854

§ 371 Date: Aug. 27, 1998

§ 102(e) Date: Aug. 27, 1998

[87] PCT Pub. No.: WO97/26994

PCT Pub. Date: Jul. 31, 1997

[30] Foreign Application Priority Data

Jan. 23, 1996 [DE] Germany ..... 196 02 205

[51] Int. Cl.[7] ..... B02C 23/24

[52] U.S. Cl. ..... 241/56; 241/188.1

[58] Field of Search ..... 241/53, 52, 50, 241/82, 56, 154, 79.1, 57, 58, 188.1

[56] References Cited

U.S. PATENT DOCUMENTS

| | | | |
|---|---|---|---|
| 2,752,097 | 6/1956 | Lecher | 241/58 |
| 3,221,998 | 12/1965 | Lykken . | |
| 4,747,550 | 5/1988 | Jackering | 241/58 |

FOREIGN PATENT DOCUMENTS

| | | |
|---|---|---|
| 0226900 | 7/1987 | European Pat. Off. . |
| 2182416 | 12/1973 | France . |
| 4200827 | 7/1993 | Germany . |
| 4213274 | 10/1993 | Germany . |
| 29515433 | 1/1996 | Germany . |
| 19506817 | 8/1996 | Germany . |
| 381812 | 11/1964 | Switzerland . |

*Primary Examiner*—Mark Rosenbaum
*Attorney, Agent, or Firm*—Bachman & LaPointe, P.C.

[57] ABSTRACT

Apparatus for treating composite elements for the recovery of valuable substances therefrom, including providing a flow path for a transport fluid carrying solid particles from the composite elements, an array of mutually successive acceleration tools which are moved relative to a stator and which each form in the flow direction a break-away edge for producing turbulence from the transport fluid and its solid particle load, wherein the accretion tools are arranged at a spacing relative to each other on a structural circle in a plurality of mutually superposed acceleration planes above a housing bottom on plates about a central shaft of a rotor and within a cylindrical wall of a housing as said stator.

20 Claims, 6 Drawing Sheets

APPARATUS FOR TREATING COMPOSITE ELEMENTS

DESCRIPTION

The invention concerns an apparatus for treating composite elements comprising solid organic and/or inorganic composite materials such as composites of metal/metal, plastic/plastic, metal/plastic or mineral composites with metals and/or plastics.

Composite elements of that kind are for example tin-plated copper conductor tracks of circuit arrangements, fibre-reinforced plastic materials or copper-plated aluminium wires in co-extruded or laminated form. Thus metal-metal composites—for example in the case of coaxial cables—primarily comprise a metal carrier, for example an aluminium wire, with a galvanically or thermally applied copper layer, while plastic-plastic laminates, in the situation of use involving packaging foil for foodstuffs, comprise a plastic carrier formed by polyamides (PA) with polyethylene (PE) which is co-extruded therewith, laminated therewith or applied thereto by a lining procedure. Plastic-metal composites are also joined together by a lining or laminating procedure, for example in the case of a glass fibre epoxy plate as a carrier with the application of copper as a base material for printed circuits. Metal-plastic composites include inter alia a carrier of aluminium sheet with a protective foil stuck thereon comprising polypropylene (PP) for facing or facade panels and weather-protective cladding arrangements.

Those composite elements give rise to problems in particular in terms of disposal as hitherto the materials in the composite have not been separated. Nowadays those composite elements are almost exclusively dumped or burnt—which is not environmentally friendly—and they are thus taken out of economic circulation.

The composite elements which in future will have to be disposed of in an orderly fashion include in particular also residues from the packaging sector. It is precisely in that area that co-extruded and laminated products have hitherto been irreplaceable as the materials in the composite have in combination excellent packaging properties.

In the conventional processing procedure, the composite element is broken up by way of the grain or particle size which is smaller than the respective layer thickness of the components. This breaking-up operation is generally effected by using an at least one-stage very fine crushing operation using suitable mills, for example hammer, impact or counter-flow mills, possibly with the assistance of nitrogen for inerting and deep-freezing purposes.

The applicants' DE-OS No 195 09 808 describes a process by means of which solids particles are produced from the specified composite elements and the particles are fed to a transport fluid such as air, wherein at least one flow obstacle which crosses the flow of the mixture of solids particles and transport fluid is moved relative to that flow, acting as a break-away edge for forming downstream turbulence phenomena which break up the mixture by an acceleration effect. At the transition into those turbulence effects, there is both an abrupt increase in the acceleration of the solids particles and also their friction against each other, which causes them to break up. The mixture of transport fluid and solids particles is fed to the separation or break-up procedure at the break-away edges at an acceleration of between 20 and 25 m/sec$^2$ after the composite elements to be treated have been coarsely crushed or however compacted prior to the separation or break-up procedure. In accordance with DE-OS No 195 09 808 the composite substances are pre-crushed to form particles which are above the grain size of fine crushing operations and are then fed to the separation or break-up zone and thus accelerated in the air flow. The individual substances in the composite are liberated and the physically different metallic layers and also the plastic layers separate from each other. That separation procedure takes place along the phase boundaries.

FR-A 1 562 013 discloses a crushing mill with a rotor having a plurality of rotary disks, and a cylindrical housing which embraces the rotor, in which material being conveyed, which is to be crushed, is passed by a screw to the lower end of the rotor and is then engaged by the air flow of a fan which extends over the rotor, above the sieve bottom and beneath the rotary bearing. The upwardly moving crushing material is crushed by what are referred to as "plaques de broyage", that is to say crushing or squashing plates which project radially from rotating rotor plates and which are arranged in the proximity of the housing wall. The crushing or squashing plates which co-operate with the housing wall are each provided at their end with an elliptical frame; those frames extend on a structural circle at the inside of the housing and are intended to help to enhance the crushing and grinding action. Moreover the author of FR-A 1 562 613 takes the view that turbulence phenomena are additionally also involved in that crushing procedure. Adjoining the housing of that crushing mill beneath the fan is a by-pass which again carries the sieved-off coarse components to the lower feed means.

DE-A-42 00 827 also describes such a crushing mill wherein arranged downstream of the upward outlet opening thereof are two successively connected cyclones, as separators. The crushed material which occurs in the first cyclone is brought together by way of a worm or screw with the crushed material of the second cyclone, and the two components are removed by a bladed wheel-type sock assembly.

An installation as disclosed in DE-A-42 13 274 includes, as one of the units, the crushing mill of FR-A-1 562 613 and describes a particular configuration of crushing plates mounted on the stator, as well as a radial discharge passage near the crushing plates. Arranged in the discharge passage is a baffle bar for the crushing material, the bar being of triangular configuration in plan view.

In consideration of that state of the art, the inventor set himself the aim of developing an apparatus of the kind set forth in the opening part of this specification, with which composite elements can be so treated that recovery of valuable substances can be effected; the invention seeks to provide that the composite materials can be put back into economic circulation, without adversely affecting the environment. The invention further seeks to provide that the apparatus can be advantageously adapted to the process conditions.

The teaching of the present invention provides for attainment of that object.

In accordance with the invention above a housing bottom and a mouth opening, and adjacent a central rotor shaft, the rotor carries a distribution disk with distribution arms as entrainment means. Distribution arms are associated with the distribution disk and extend between the rotor shaft and the disk edge. In addition at its rotor shaft, between the distribution disk and an accumulation plane which spans the rotor and which is near the discharge, the rotor has a plurality of acceleration planes with acceleration tools which are radial and parallel to the axis of the rotor shaft.

In accordance with the invention above a housing bottom and a mouth opening, adjacent the central rotor shaft, of a feed passage for the feed flow, the rotor carries a distribution disk with distribution arms as entrainment means, the distribution arms being associated with the distribution disk and extending between the rotor shaft and the disk edge. In addition at its rotor shaft, between the distribution disk and an accumulation plane which spans the rotor and which is near the discharge, the rotor has a plurality of acceleration planes with acceleration tools which are radial and parallel to the axis of the rotor shaft. A feature of particular significance is that the rotor shaft is mounted on the one hand at the housing bottom and on the other hand with the free shaft end arranged beneath same at a spacing therefrom; the upper part of the rotor shaft with the above-described acceleration and accumulation planes therefore remains mounting-free and is thus readily accessible from above.

In accordance with a further feature of the invention the entrainment means or distribution arms are curved at the underneath surface of the distribution disk, extending parallel thereto, in order to ensure advantageous distribution of the solids at the periphery. For that purpose, it is also provided that the height of the free end of the distribution arm can be greater than the height of its adjoining central region; that arrangement permits a better flow of the material out of the feed passage to the housing wall.

It has also been found advantageous for the distribution disk to be connected to an acceleration plate which engages over same and which is provided at its peripheral edge with a plurality of the acceleration tools; this involves a structural unit comprising the distribution disk and the lower acceleration plate.

Advantageously, integrated into the distribution disk is a central carrier hood which opens away therefrom and which protectively engages over a mounting region, which is still to be described below, for the rotor shaft.

In accordance with the invention, an accumulation plane is to be formed by an accumulation plate, over a plurality of acceleration planes which overlie the distribution disk and which have the acceleration tools; that accumulation plate is provided with flat profile portions as accumulation tools, the flat profile portions projecting radially from the accumulation plate and being parallel to said plane. The accumulation tools regulate the discharge of the components which already arrive at same in a separated condition. In accordance with the invention moreover inserted intermediate plates extend between the acceleration planes.

In order to be able to compensate for rotor unbalances which occur, without involving problems, at least the accumulation plate is to be provided with receiving means for weight elements, preferably on a common structural circle; it will be appreciated that it is possible for such cavities also to be arranged at peripheral positions on other rotor elements. Preferably the receiving means is in the form of a depression in the accumulation plate, which is spanned by a cover.

A feature that serves for assembly of the rotor is that both the accumulation plate and also the above-mentioned acceleration planes are respectively provided with a central hub bush or sleeve for the rotor shaft and the hub bush or sleeve is provided with thrust passages, which extend therethrough parallel to the shaft, for tie bars—and between same with screw holes; the tie bars which approximately correspond in respect of length to the active rotor height are screwed towards the ends into screwthreaded blind holes in a central hub sleeve of the distribution disk and press the mutually superposed hub sleeves against each other.

In addition individual ones of the disk-like rotor elements can be more easily axially moved if for that purpose the tie bars are fixed with their ends in the screw holes in the hub sleeves and are then used as manipulation aids.

It is also in accordance with the invention that the acceleration tool is a material plate which is provided displaceably on a radial arm of the acceleration plate or the disk-like acceleration plane, and is releasably connected to the radial arm by a screw.

Both the radial arm and also the acceleration tool advantageously have a partial tooth profile at the surface which is towards the co-operating assembly component; the two tooth profiles engage meshingly one into the other in the operative position and simplify alignment and fixing.

For that purpose it has been found desirable for at least one of the co-operating assembly components to be provided with a releasable insert portion—preferably an insert wedge or key—which has longitudinal ribs as the tooth profile. The longitudinal ribs or channel grooves of the co-operating assembly component are oriented preferably parallel to the axis of the rotor shaft.

The above-described configuration of the tools permits them to be easily and rapidly changed without thermally influencing the material.

As mentioned above the rotor shaft is mounted at one end outside the active rotor region. In addition outside the interior of the housing it extends in a shaft tube which is interchangeably fixed at one end at the housing bottom. It has been found desirable for the mounting means for the free end of the rotor shaft to be axially movably mounted in the shaft tube.

For the purposes of axial thrust compensation that mounting means or a loose ring element associated therewith should also be axially connected to the shaft tube by way of force-storage means. For that purpose, diaphragm or plate springs can be mounted in cavities in the ring element, which springs bear against axis-parallel set screws or studs or the like members of the shaft tube; those set screws or studs are fitted into the free edge of the tube.

A feature which serves for better handling of the apparatus provides that a connecting tube which is associated with the accumulation plane and which is advantageously directed tangentially relative to the rotor, for issue of the treated material out of the interior of the housing, is integrated into the housing itself, but not into the housing cover thereof; if the latter is removed, the connecting tube remains on the housing, for the sake of simplicity.

The rotor which is mounted outside or beneath the interior of the housing can be readily lifted and removed, after removal of the housing cover. If the flow of material should not be upwardly from below through the air guide action, as is preferred—the tangential connecting tube serving for discharge of the material—, then in another configuration the flow of material is introduced through the connecting tube into the housing and is then deflected downwardly.

With the conveyor direction for the flow of material usually being a rising direction, the flow of material is brought from below to the housing bottom, through a feed passage; in accordance with a further configuration of the invention, any heavy material which is possibly deposited there can be drawn off through a heavy material discharge.

The feed passage and the heavy material discharge are disposed in a base support structure which, in accordance with the invention, is spanned by a cover plate forming the housing bottom, and consequently accommodates the doubly-mounted free part of the rotor shaft. The base support structure makes it possible to mount housings of different diameters, for rotors of different sizes, on the cover plate.

In accordance with the invention the drive unit for the rotor is carried on a lateral base attachment portion of the base support structure and is connected to the lower end of the rotor by an endless elongate drive member, for example a V-belt group, which also permits drive variations.

The core of the invention is a rotor with a vertical rotor shaft which is already known per se from French laid-open application No. 1 562 013. For a particular composition of material however it may also be desirable to depart from that orientation, that is to say for the rotor and/or the drive unit to be arranged inclinedly or in a lying position, and such constructions are also intended to be embraced by the invention.

Further advantages, features and details of the invention are apparent from the following description of preferred embodiments and with reference to the drawing in which.

Figure 1:
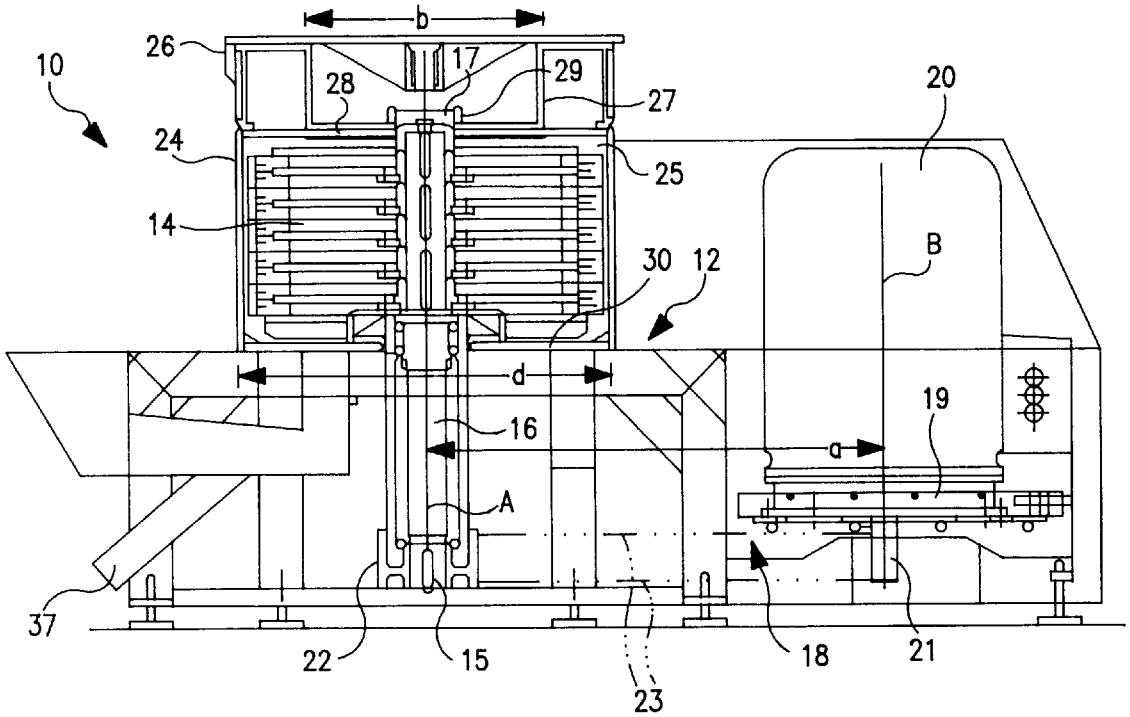
FIG. 1 is a side view of an apparatus for treating composite elements.
Figure 2:
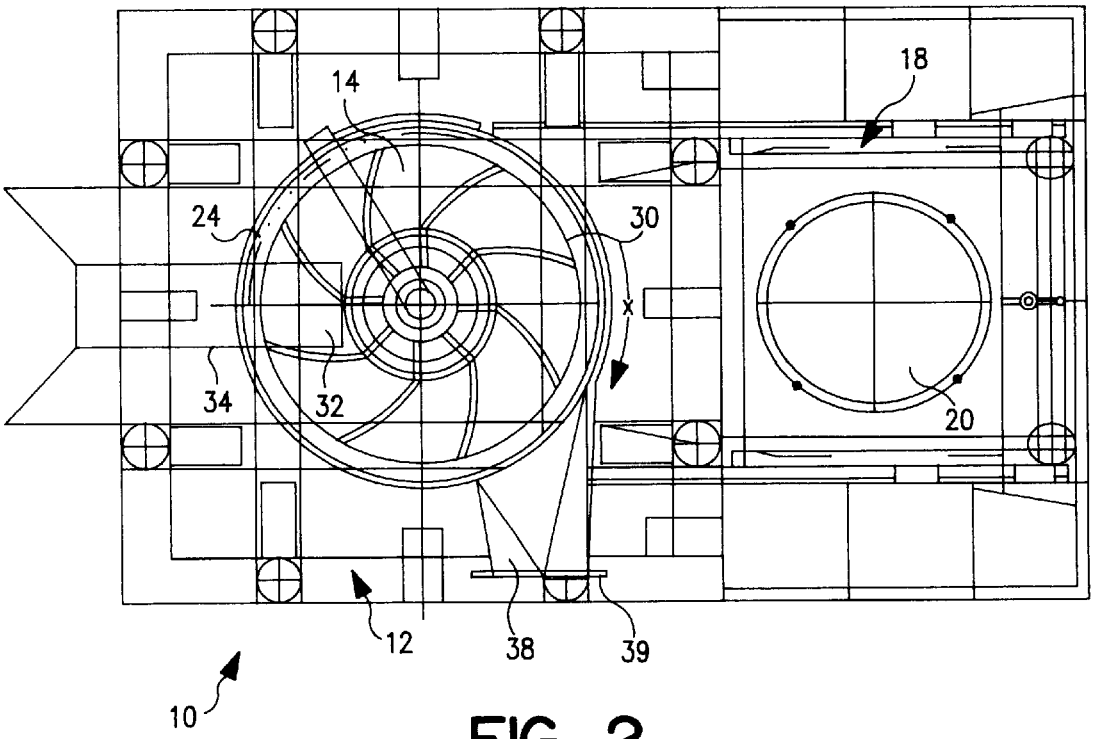
FIG. 2 is a plan view of FIG. 1.
Figure 5:
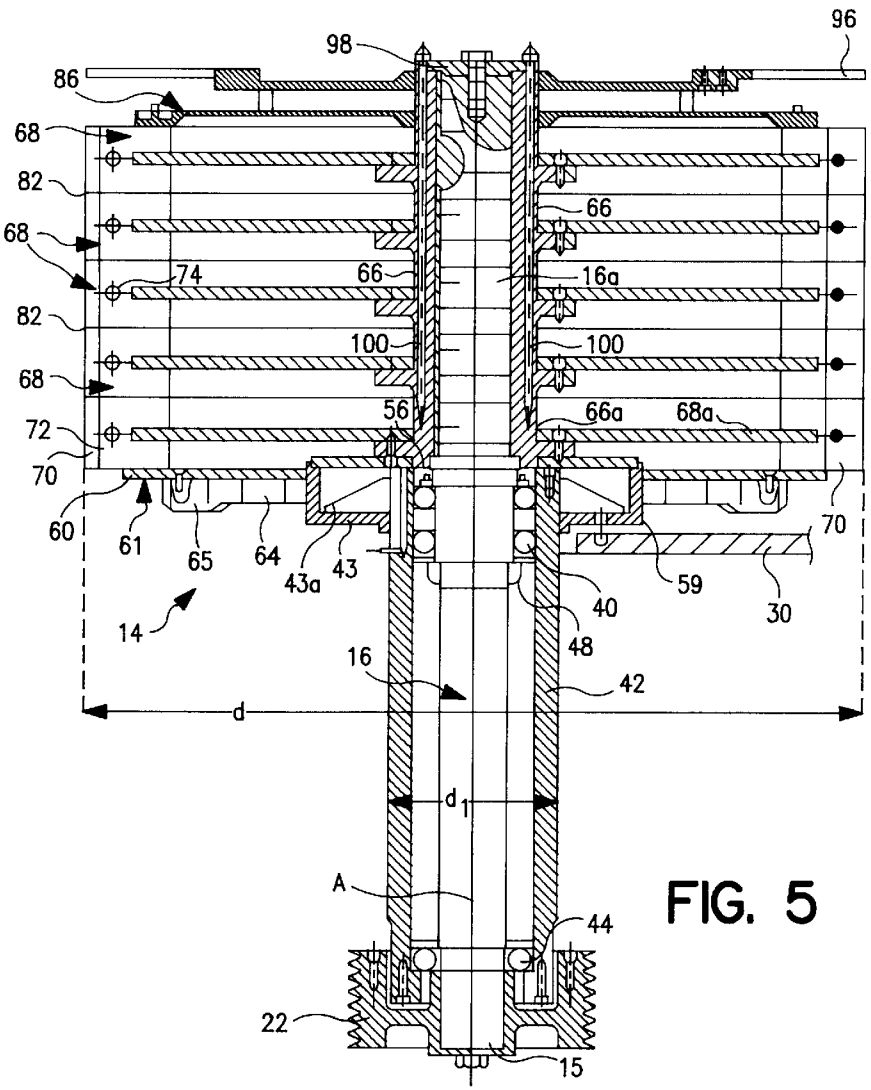
Figure 3:
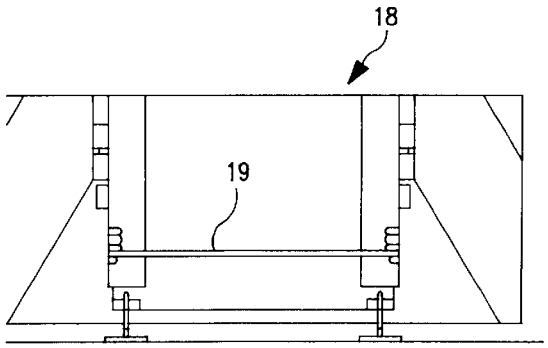
Figure 4:
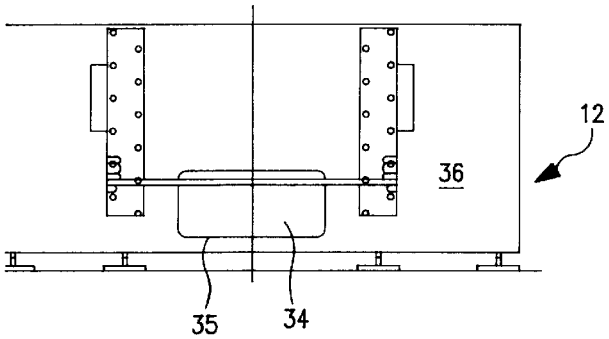
Figure 6:
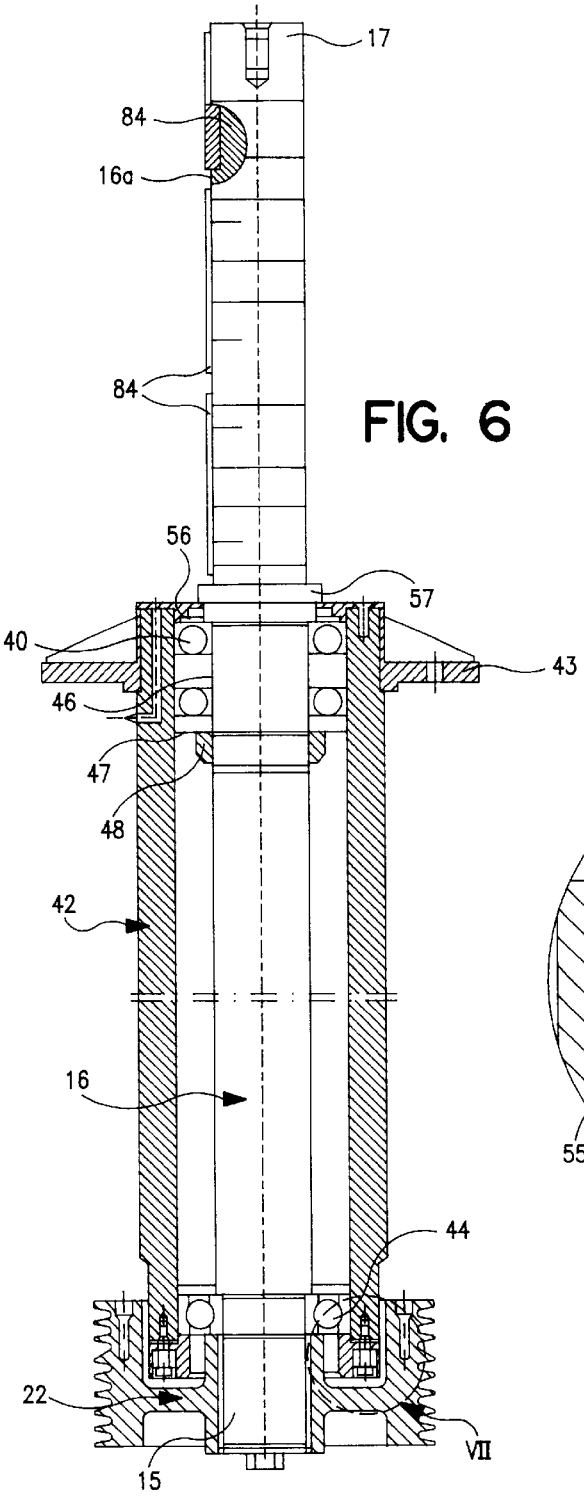
Figure 7:
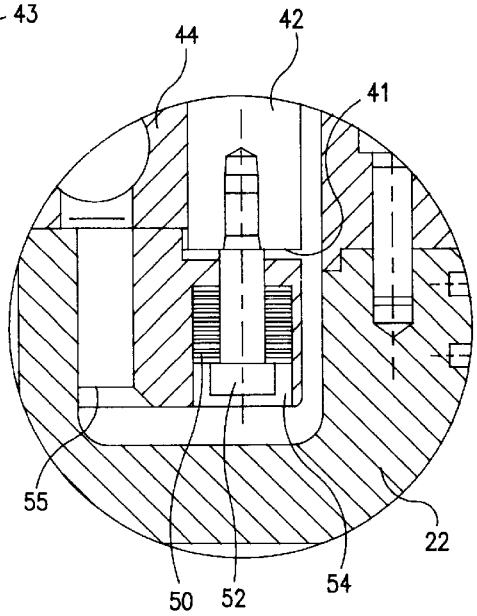
Figure 10:
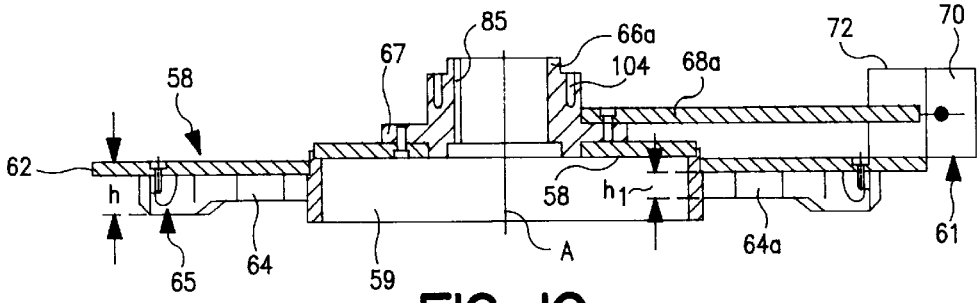
Figure 8:
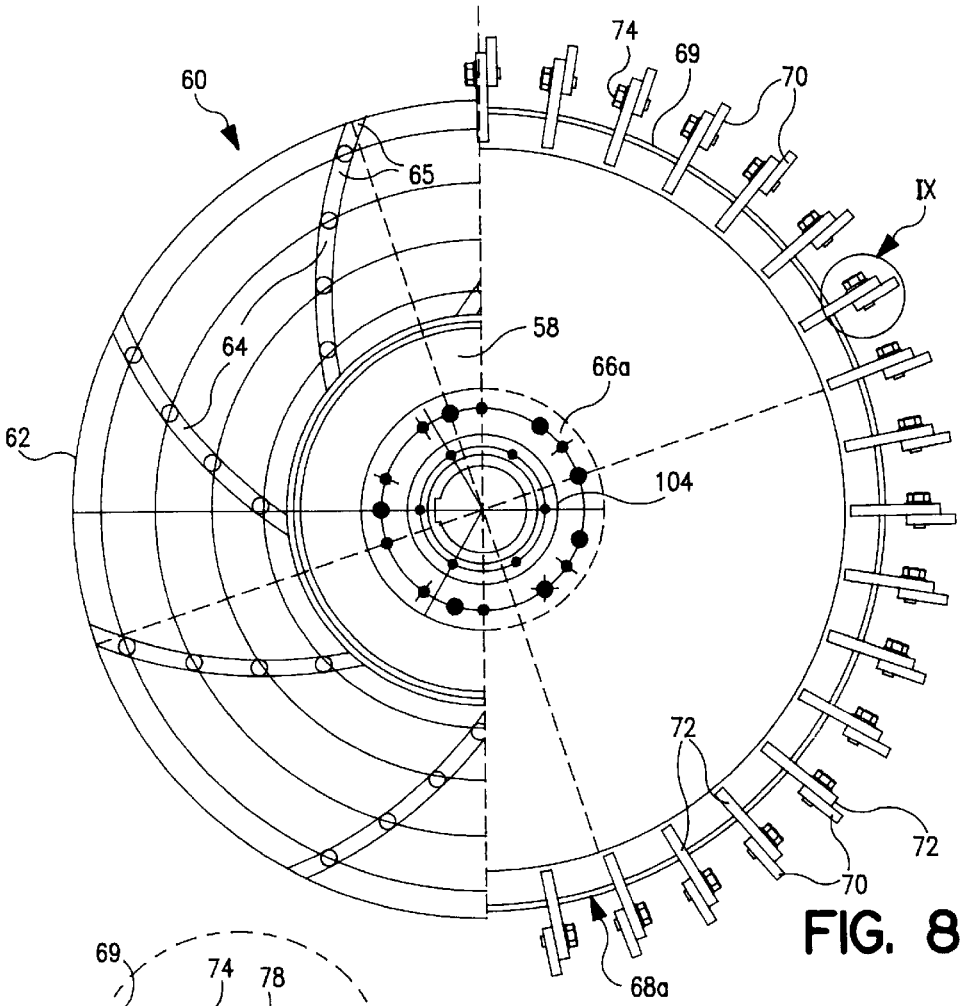
Figure 9:
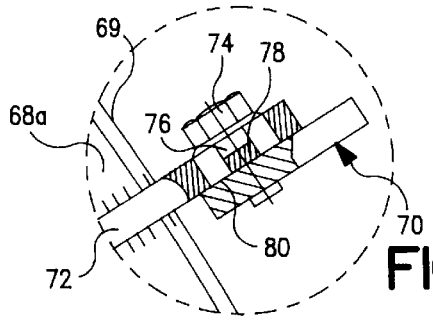
Figure 12:
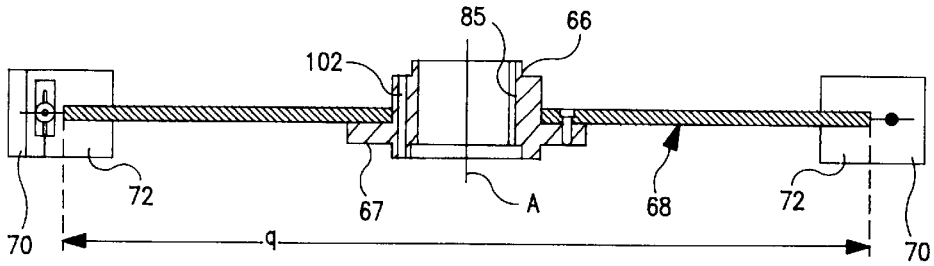
Figure 11:
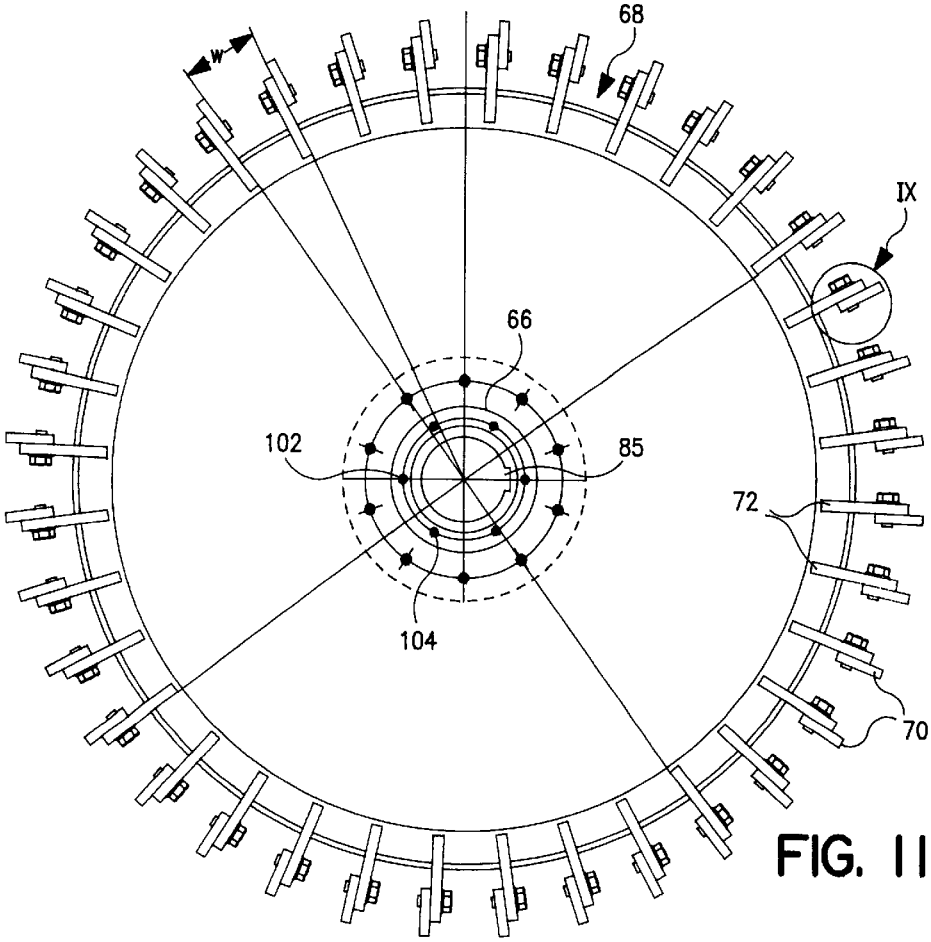
Figure 13:
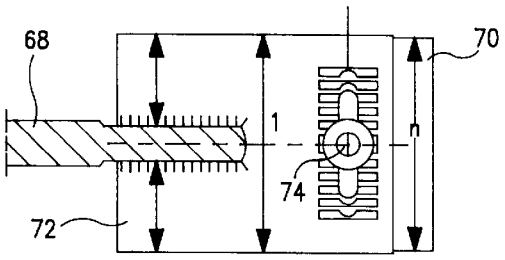
Figure 14:
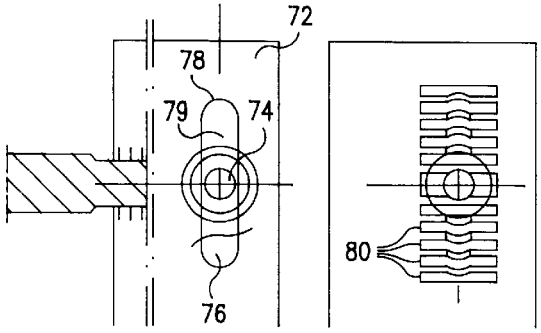
Figure 16:
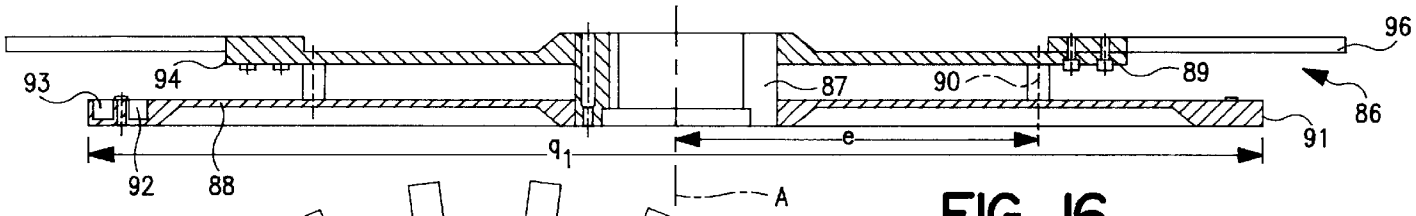
Figure 15:
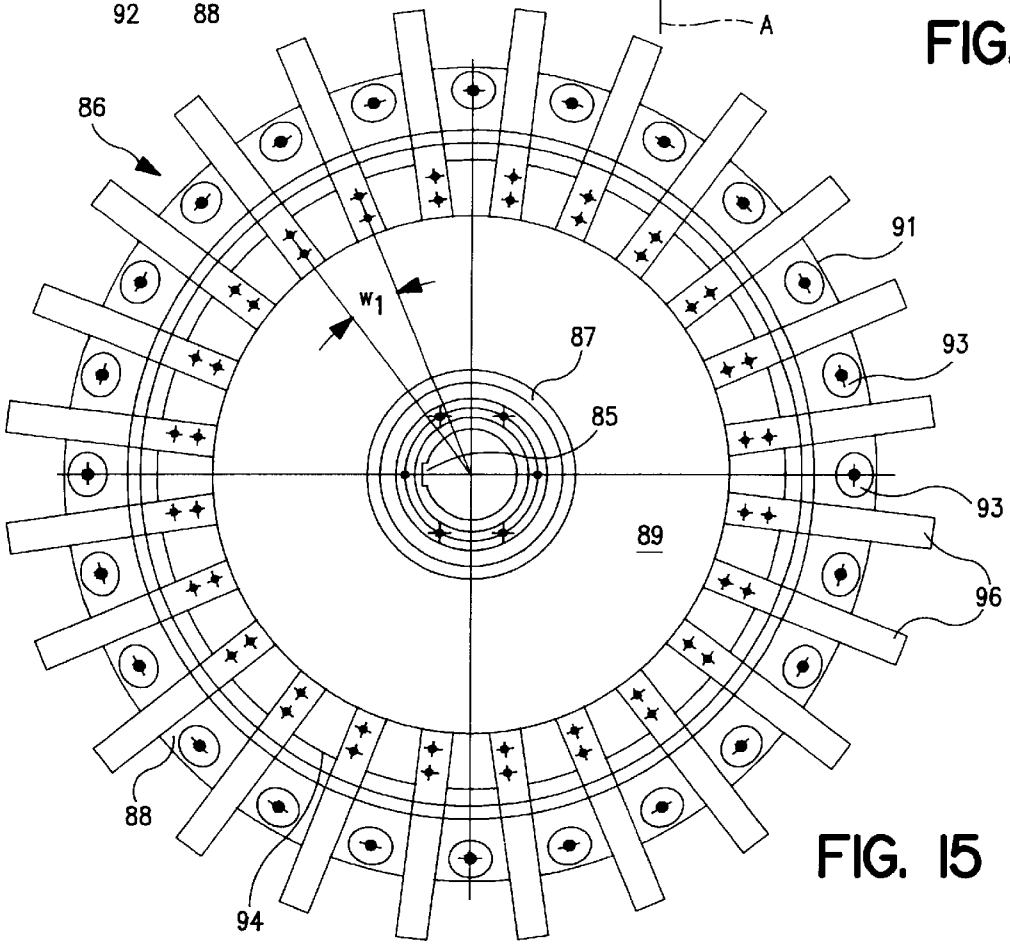

FIGS. 3 and 4 are diagrammatic rear and front views of a base support structure of the apparatus, FIG. 5 is a view on a larger scale than FIGS. 1 to 4 in longitudinal section through a rotor of the apparatus, FIG. 6 shows the rotor shaft on an enlarged scale in comparison with FIG. 5, FIG. 7 shows a portion from FIG. 6 on an enlarged scale, as indicated by arrow VII therein, FIG. 8 is a plan view of a distribution disk of the rotor, which forms a structural unit with a parallel acceleration plane of which half is diagrammatically shown at the right in FIG. 8, FIG. 9 is a detail on an enlarged scale of the acceleration plane of FIG. 8 in accordance with arrow IX therein in the form of a radially projecting tool which is shown partly in section, FIGS. 10 and 12 are diametral sections through FIG. 8 and FIG. 11 respectively, FIG. 11 is a plan view of a further acceleration plane shown as being turned through 180° relative to the acceleration plane in FIG. 8, FIG. 13 is a front view of a tool of the acceleration plane together with holding means, on a larger scale than FIG. 12, FIG. 14 shows two parts of the tool and its mounting means, which are illustrated separated from each other, FIG. 15 is a plan view of an upper accumulation plane of the rotor, and FIG. 16 is a diametral section through FIG. 15 on a larger scale.

Composite elements of solid organic and/or inorganic composite materials such as composites of metal/metal, plastic/plastic, metal/plastic or mineral composites with metals and/or plastics are reduced in size to a grain size of between about 5 and 50 mm and are then selectively broken up by an acceleration procedure in a separating or breaking-up apparatus 10.

The apparatus 10 has in a parallelepipedic base support structure 12 a rotor 14 with vertically arranged rotor shaft 16 and a base attachment portion 18 with adjustable supports 19 for a drive unit 20; the lower end of the rotor shaft 16 carries a V-groove sleeve 22 which is connected to the drive shaft 21 of the drive unit 20 by means of a plurality of narrow V-belts indicated at 23. The spacing a between the rotor axis A and the drive axis B is variably adjustable by displacement of the drive unit.

Above its base support structure 12 the rotor 14 of for example an outside diameter d of 1200 mm is surrounded by a cylindrical housing 24 whose interior 25 is closed upwardly by means of an interchangeable housing cover 26; on its inside it carries a central projection 27 of a diameter b of about 600 mm. The disk-like bottom 28 of the projection 27 extends in the proximity of the upper end 17 of the rotor 16 and provides a receiving means 29 for same.

The mouth opening 32 of a feed passage 34 for the air-controlled flow of crushed composite elements is provided in a cover plate 30 of the base support structure 12, the cover plate 30 serving as a housing bottom—near the rotor shaft 16 which passes with play through the cover plate 30; the feed passage 34 provides a connecting portion 35 at the front 36 of the support structure. A heavy material discharge 37 extends behind the connecting portion 35; heavy suspended pieces drop downwardly out of the air-controlled flow of material and are removed by virtue of the heavy material discharge 37 from the cover plate 30.

In the head region of the rotor 14 a discharge tube 38 with connecting flange 39 projects tangentially from the housing 14. As the discharge tube 38 is fixed on the housing 24, the housing cover 26 can be easily lifted, for example for replacement of the rotor 14. In particular uses the discharge tube 38 can also be used for the intake; in that case, conveyance of the flow of material occurs in a direction which is the reverse to the above-described procedure. The drawings do not show housing doors and control boxes or the like attachments which are mounted to the housing 24.

The rotor shaft 16 is mounted in the region of the cover plate 30 by means of an inclined ball bearing assembly 40 in a shaft tube 42 of an outside diameter $d_1$ of about 260 mm, with its lower end 15 resting in a groove-type ball bearing assembly 44. The shaft tube 42 terminates upwardly with a mounting collar 43 which has reinforcing ribs 43, and with which the rotor 14—which is rotatable in the shaft tube 42—is suspended in the base support structure 12 and screwed to the cover plate 30 thereof.

To compensate for the bearing forces in the upper fixed bearing, the inclined ball bearing assembly 40 which is provided with inner spacer sleeves or bushes 46 and which adjoins a shaft nut 48 below an accumulation disk 47 provided with a further spacer sleeve or bush $46_a$, the shaft tube 42 is braced against diaphragm or plate springs 50; the latter surround set screws or studs 52 which are disposed perpendicularly to the tube edge 41 in the shaft tube 42 and are mounted in cavities or bores 54 in a load-relief ring 55 which is supported against the lower ball-bearing assembly 44, a loose bearing.

FIG. 6 shows above a tube cover 56 a collar 57, which overlies the tube cover 56, of the free portion $16_a$ of the rotor shaft 16. That free rotor portion $16_a$, with its attachment portions that are still to be described, defines the active rotor region.

Extending at the level of the collar portion 57 is the end 58 of a central carrier hood 59 for a distribution disk 60, the hood 59 opening downwardly and receiving the above-mentioned mounting collar 43 on the tube shaft 42. Distribution arms 64, of which there are eight here, are interchangeably screwed fast to the underneath surface 61 of the distribution disk 60. As shown in FIG. 8 each distribution arm 64 is curved approximately in the form of an e-function at the underneath surface 61—that is to say horizontally—and forms an entrainment means for transport of the composite particles guided through the feed passage 34 onto the cover plate 30, from the mouth opening 32 to the peripheral edge 62 of the distribution disk 60. In addition the height h of the free end 65 of the distribution arm 64 is greater than its height $h_1$ in a region $\mathbf{64}_z$ which adjoins the central carrier hood 59.

Moreover for reasons of clarity of the drawing a configuration of the distribution arms 64 comprising arm portions which are mounted at spacings relative to each other, that is to say an interrupted distribution arm, is not illustrated.

Carried on the carrier hood 59 of cylindrical contour is a hub sleeve or bush $\mathbf{66}_a$ with a radial spacer collar 67 to which a first acceleration plate $\mathbf{68}_a$ is screwed; the acceleration plate affords an acceleration plane and at its peripheral edge 69 carries a plurality of radially projecting acceleration vanes or blades 70 as tools. The acceleration plate $\mathbf{68}_a$ and the distribution disk 60 form a structural unit. Adjacent acceleration blades 70 define relative to each other an angle w at the centre which in this case is about 10°.

The plate-like acceleration blade 70 is of a particular configuration in dependence on the respective purpose of use and in the selected embodiment—as can be seen in particular from FIG. 9—it is interchangeably screwed to a side surface of a flat bar 72 or radial arm which is welded on perpendicularly to the surfaces of the acceleration plate $\mathbf{68}_a$; the acceleration plate $\mathbf{68}_a$ engages centrally into the flat bar 72, that is to say it is associated with both surfaces of the plate, in equal parts (heights i in FIG. 13). The over height $i_1$ of the flat bar 72 is somewhat greater than the height n of the acceleration plate or blade 70. It is held to the flat bar 72 by means of a screw 74 passing through the two components, and is thus easily interchangeable.

In order to permit rapid fixing of the acceleration blade 70 to the flat bar 72, at least one insert wedge 78 is disposed therein, in a slot-like opening 76 which is parallel to the axis A of the rotor. The insert member 78 has longitudinal ribs 79 which are directed parallel to the axis and which engage between rows of spline grooves 80 of a corresponding tooth profile of the acceleration blade 70. The insert member 78 is held in the opening 76 in the flat bar 72 by the acceleration blade 70 which bears firmly thereagainst, by virtue of the screw 74.

With the interposition of respective intermediate plates 82, the structural unit $\mathbf{60/68}_a$ is spanned over by four further plate-like acceleration planes 68 whose hub sleeves or bushes 66 are disposed axially one upon the other around the free portion $\mathbf{16}_a$ of the rotor shaft 16 and are held by fitting keys 84 which are screwed to them; the latter engage into key grooves 85 in the hub sleeves 66.

On the intermediate plate 82 of the uppermost acceleration plane 68 an accumulation plate 86 forms an accumulation plane comprising two disks 88, 89 which are fixed to a holding sleeve 87. Spacer pins 90 are disposed between the disks 88, 89, at a distance e from the axis A of the rotor.

Bowl-shaped depressions 92 are formed in the underneath disk 88, near the peripheral edge 91 thereof, the underneath disk being of a diameter $q_1$ approximately corresponding to the diameter q of 1050 mm of the acceleration plane 68, and are closed by a bowl cover 93 held by a central screw. Additional weights for remedying unbalances can be fitted into the depressions 92.

The upper disk 89 of the accumulation plate 86 is of smaller diameter than the underneath disk 88 and carries accumulation tools 96 projecting radially from the peripheral edge 94 thereof, in the form of flat profile members which are screwed thereon. Two adjacent accumulation tools 96 define an angle $w_1$ at the centre of 15°.

The holding sleeve 87 of the accumulation plate 86 is spanned over by an attachment cover 98 screwed to the rotor shaft 16 on the axis A of the rotor. It will be seen from FIG. 5 in that respect that—preferably three—tie bars 100 pass through both the cover 98 and also thrust passages 102 of the mutually superposed hub sleeves 66 in parallel relationship with the axis A of the rotor and are fitted with screw ends in screw holes 104 in the distribution disk 60.

FIG. 11 also shows by way of example three finite screw holes 104 between three passages 102; the screw holes 104 make it possible to engage and lift the respective hub sleeve 66 by means of the tie bars 100, as an assembly aid.

The housing 24 serving as a stator delimits as one side the flow path for a mixture of solids particles and carrier fluid, for example air, which mixture is introduced through the feed passage 34 in the proximity of the rotor shaft 16; the other side of the flow path is delimited in the five stages indicated in FIG. 5 by the acceleration blades or plates 70. The mixture of solids particles and transport air is fed on the distribution disk 60—arcuately by virtue of the distribution arms 64 thereof—to a narrow annular space between the housing 24 and the rotor 14 in the region of the acceleration blades 70 of the structural unit $\mathbf{60/68}_a$, in such a way that it flows in opposition to the direction of rotation x of the rotor 14. In that situation, as viewed in the direction of rotation x, behind each acceleration blade 70 which affords a break-away edge, a tail or downstream turbulence or eddy is produced. In the turbulence the flow of mixture is abruptly accelerated, and the solids particles are rubbed against each other and in that situation broken up into their components. For that purpose the peripheral speeds of the break-away edge, the process temperature and the quantitative air through-put can be preselected and adjusted.

Before passing into the next stage, the flow of mixture can temporarily expand in the above-mentioned gap in order then to pass in the downstream-disposed annular space. In the region of the accumulation plate 86 the components of the solids particles, which are guided upwardly and which are broken up when that happens, pass to the discharge tube 38.

The composite element is selectively broken up by liberation of the different physical properties of the composite materials—in particular density, elongation to fracture, resiliency, thermal expansion and heat transfer as well as elasticity and the molecular structural differences involved therewith, and the adhesions of the composite materials relative to each other are broken down.

The treatment in the breaking-up unit 10 causes the composite element to be broken up into different structures, in which respect the individual components also behave differently in terms of dimensions and geometry, as a result of their different characteristics.

As stated, the composite elements can be compacted prior to the breaking-up procedure. It has been found that, with this selective breaking-up procedure, the constituents of polyethylene remain substantially unaltered while metal constituents, for example of aluminium—which were previously in flat form—are deformed into onion-shaped structures. Plastic composites, for example polystyrene/polyethylene, break up without noticeable deformation into different structures with detectable differences in relation to particle sizes; they are considerably larger than the above-mentioned aluminium onion-like structures.

The individual layers of the composite element are separated off by the selective breaking-up procedure without the layer thickness of the components being reduced.

We claim:

1. Apparatus for treating composite elements having at least one of solid organic composite materials and solid inorganic composite materials, which comprises:

a flow path having a flow direction for a transport fluid carrying solid particles produced from the composite materials by crushing;

an array of mutually successive acceleration tools which are moved relative to a stator and which each form a break-away edge in the flow direction for producing turbulence from the transport fluid and its solid particle load;

wherein the acceleration tools are arranged at a spacing relative to each other on a structural circle in a plurality of mutually superposed plate-like acceleration planes above a housing bottom on plates about a central shaft of a rotor and within a cylindrical wall of a housing as said stator, with the rotor located at least in part above the housing bottom;

wherein said housing with the plates is provided between a lower feed passage having a mouth opening thereof and an upper discharge and defines an annular space for said flow path, with said mouth opening adjacent the central shaft;

said rotor carrying a distribution disk with distribution arms associated therewith, said arms extending between the rotor shaft and the disk edge as entrainment means; and an accumulation plane which spans the rotor and which is adjacent to the discharge, wherein between the distribution disk and accumulation plane the rotor has said plate-like acceleration planes with the acceleration tools, wherein the acceleration planes are radial and parallel with respect to the rotor axis (A), with the rotor shaft mounted on the one hand at the housing bottom and on the other hand with a shaft end arranged at a spacing below the housing bottom.

2. Apparatus according to claim 1, wherein said composite materials are selected from the group consisting of metal/metal composites, plastic/plastic composites, metal/plastic composites, mineral composites with metal, and mineral composites with plastic.

3. Apparatus according to claim 1, wherein the distribution arms are curved at the underside of the distribution disk and extend parallel thereto.

4. Apparatus according to claim 1, wherein at least one distribution arm is interrupted.

5. Apparatus according to claim 1, wherein the height (h) of the free end of the distribution arms is greater than the height ($H_2$) of their adjoining central region.

6. Apparatus according to claim 1, wherein the distribution disk is connected to an acceleration plate, and wherein the acceleration plate is provided at its peripheral edge with the acceleration tools.

7. Apparatus according to claim 1, wherein a central carrier hood is integrated into the distribution disk, with said hood opening away from the distribution disk.

8. Apparatus according to claim 7, wherein the rotor shaft, which is mounted at one end outside the active rotor region, extends in a shaft tube which is fixed at one end to the housing bottom.

9. Apparatus according to claim 8, wherein the carrier hood of the distribution disk engages over a mounting collar of the shaft tube, which collar is connected to the housing bottom.

10. Apparatus according to claim 8, wherein a bearing for the free end of the rotor shaft is axially movably mounted in the shaft tube, and wherein at least one of said bearing and a loose ring element associated with said bearing is axially connected to the shaft tube by way of force storage means.

11. Apparatus according to claim 10, wherein plate springs are supported in cavities in the ring element and bear against axis-parallel set screw means of the shaft tube.

12. Apparatus according to claim 1, wherein said accumulation plane is formed by an accumulation plate over a plurality of acceleration planes which overlie the distribution disk and which have the acceleration tools, wherein the accumulation plate is provided with radial flat profile portions parallel to said accumulation plane as accumulation tools.

13. Apparatus according to claim 12, wherein the accumulation plate has a central hub sleeve for the rotor shaft, and the hub sleeve is provided with thrust passages which extend therethrough parallel to the shaft for tie bars.

14. Apparatus according to claim 1, wherein the distribution disk has a central hub sleeve with finite screw holes.

15. Apparatus according to claim 1, wherein the acceleration plane is formed by an acceleration plate, and wherein each acceleration tool is a material plate which is provided adjustably on a radial arm of the acceleration plate.

16. Apparatus according to claim 15, wherein both the radial arm and the acceleration tool, at the surface towards a cooperating assembly component, have a partial tooth profile, and the tooth profiles meshingly engage into each other in the operative position, wherein at least one cooperating assembly component is provided with a releasable insert portion the tooth profile of which is formed by longitudinal ribs.

17. Apparatus according to claim 16, wherein said longitudinal ribs of the cooperating assembly component are directed parallel to the axis (A) of the rotor shaft.

18. Apparatus according to claim 1, wherein a connecting tube of the housing interior, which tube is associated with the accumulation plane, is integrated into the housing.

19. Apparatus according to claim 1, wherein a heavy material discharge extends from the housing bottom.

20. Apparatus according to claim 1, wherein the rotor shaft of the rotor is set at an angle relative to the vertical.

* * * * *

UNITED STATES PATENT AND TRADEMARK OFFICE

CERTIFICATE OF CORRECTION

PATENT NO. : 6,065,697
DATED : May 23, 2000
INVENTOR(S) : RUDOLF ENGEL ET AL.

It is certified that error appears in the above-identified patent and that said Letters Patent is hereby corrected as shown below:

In Column 2, line 36, "sock" should read --lock--;

In Column 6, line 35, "ribs 43" should read --ribs $43_a$--;

In Column 10, claim 15, line 33, before "acceleration" "a" should read --the--;

In Column 10, claim 16, line 37, before "cooperating" "a" should read --the--; and In Column 10, claim 17, line 44, "are" should read --is--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*